United States Patent [19]

Karuzas

[11] Patent Number: 4,642,827

[45] Date of Patent: Feb. 17, 1987

[54] BOTTLE OPENER AND LIGHTER COVER

[76] Inventor: Jonas Karuzas, 2329 Brinell Avenue, Burlington, Ontario, Canada, L7R 3T5

[21] Appl. No.: 797,479

[22] Filed: Nov. 13, 1985

[51] Int. Cl.[4] ..... B25F 1/04

[52] U.S. Cl. ..... 7/151

[58] Field of Search ..... 7/151; 81/3.09, 3.55, 81/3.57; 431/253

[56] References Cited

U.S. PATENT DOCUMENTS

| | | | |
|---|---|---|---|
| 1,707,804 | 4/1929 | Haase | 81/3.09 |
| 2,020,205 | 11/1935 | Perkins | 81/3.57 |
| 4,361,920 | 12/1982 | Zanni | 7/151 |
| 4,373,223 | 2/1983 | Miller | 7/151 |
| 4,560,344 | 12/1985 | Kietaibl | 7/151 |
| 4,569,653 | 2/1986 | Becker et al. | 7/151 |

FOREIGN PATENT DOCUMENTS

| | | | |
|---|---|---|---|
| 2236894 | 2/1974 | Fed. Rep. of Germany | 81/3.57 |

*Primary Examiner*—Roscoe V. Parker

*Attorney, Agent, or Firm*—Wegner & Bretschneider

[57] ABSTRACT

A combination bottle opener and lighter case having an elongate body with an internal hollow chamber. There is an opening at one end of the body so that a disposable lighter can be inserted longitudinally into the chamber. A notch for removing a crown cap is located in the side of the bottle opener a short distance from one end of the body. The notch forms a fulcrum at one end thereof and a prying lip at the opposite end thereof. The fulcrum and prying lip are formed such that the opener can be placed on a crown cap in such a manner that the lip engages a bottom edge of the cap and the fulcrum engages, and extends partially cross, the top surface of the cap so that when the opener is pivoted upwardly with respect to the bottle, the cap is removed.

10 Claims, 4 Drawing Figures

BOTTLE OPENER AND LIGHTER COVER

BACKGROUND OF THE INVENTION

This invention relates to bottle openers and in particular an opener adapted to remove a crown cap.

Various designs for bottle openers able to remove crown caps are known at present. A simple well known opener for this purpose has an elongate handle with an opening mechanism at one end. The opening mechanism is formed by means of a hole that has a fulcrum on one side and a prying lip on the other side. The fulcrum and the prying lip are formed so that the opener can be placed on a cap in such a manner that the lip engages a bottom edge of the cap and the fulcrum engages the top surface of the cap such that when the opener is pivoted upwardly with respect to the bottle, the cap is removed.

It is also known to combine a bottle opener with another device that can be used for other purposes. For example, the provision of a bottle opener on a jack knife is well known. The provision of a bottle opener on a gas lighter is taught in U.S. Pat. No. 4,361,920 issued Dec. 7, 1982 to Fiap S.r.l. In the device of this patent, the gas lighter which is of the piezoelectric type, has an end that is shaped both to be hung up and to be utilized as a bottle opener. The body of the gas lighter acts as a handle for the opener so that the user will have the necessary leverage when he is removing a crown cap. However, the device of this patent requires a gas lighter of special construction and because of the combined size of the gas lighter-bottle opener, the device is not particularly suited for carrying in one's pocket.

U.S. Pat. No. 4,373,223 issued Feb. 15, 1983, to Mildoy Enterprises discloses a bottle opener that also acts as a container for a disposable lighter. The opener has an elongate plastic body with a hollow internal chamber, open at one end, such that a disposable lighter may be snuggly inserted into the chamber. It has a recessed opening at the opposite end that provides a crown cap removing mechanism. The advantage of this known opener is that it can be conveniently carried in a purse or pocket without significantly adding to the user's collection of paraphernalia. There are disadvantages however to this known container opener, including the fact that the container opener must be longer than the body portion of the lighter (which contains the lighter fluid) in order to provide room for the opening mechanism. This makes the device more awkward to carry in one's pocket. In addition, the container opener will not stand up on its end because of the rounded opening mechanism at the bottom end. Furthermore, it may be difficult to remove the disposable lighter from the opener without the use of some sort of tool.

An object of the present invention is to provide a combination bottle opener and lighter case that is inexpensive to construct and easy to use.

It is a further object of the present invention to provide a combination bottle opener and lighter case that can be used in conjunction with well known disposable lighters and that provides an effective and reliable means for removing crown caps from bottles.

SUMMARY OF THE INVENTION

According to one aspect of the invention, a combination bottle opener and lighter case comprises an elongate body having an internal hollow chamber with an opening at one end of the body such that a disposable lighter can be inserted longitudinally into the chamber.

A notch for removing a crown cap from the bottle is located in the side of the opener a short distance from one end of the body. The notch forms a fulcrum at one end thereof and a prying lip at the opposite end thereof. The fulcrum and the prying lip are formed such that the opener can be placed on a crown cap in such a manner that the lip engages a bottom edge of the cap and the fulcrum engages, and extends partially across, the top surface of the cap such that when the opener is pivoted upwardly with respect to the bottle, the cap is removed.

In one preferred embodiment, the body has a substantially oval-shaped cross section and the notch is located in a narrower side section of the body. Preferably the body is made substantially of steel.

According to a further aspect of the invention, a combination bottle opener and lighter case comprises an elongate steel body having an internal hollow chamber with an opening at one end of the body such that a disposable lighter can be inserted longitudinally into the chamber. There is a further opening at the other end of the body such that the lighter can easily be removed from the chamber by pushing on the bottom end of the lighter with the user's finger. A notch is located in the side of the opener a short distance from one end of the body. This notch forms a fulcrum at one end thereof and a prying lip at the opposite end thereof.

Further features and advantages will become apparent from the following detailed description when taken in conjunction with the accompanying drawings.

DETAILED DESCRIPTION OF PREFERRED EMBODIMENT

Figure 1:
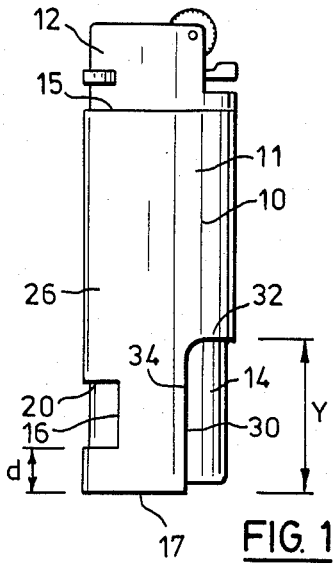
FIG. 1 is a side elevation showing a combination bottle opener and lighter case constructed in accordance with the invention and containing a disposable lighter.

A combination bottle opener and lighter case 10 constructed in accordance with the inventon has an elongate body 11 with an internal hollow chamber 13. The chamber has an oval-shaped opening 15 at an upper end of the body such that a disposable lighter 12 can be inserted longitudinally into the chamber. The well known lighter of this type has an elongate lighter fluid storage compartment 14 which, in the illustrated version, has an oval cross-section. It will be appreciated that the body 11 and the chamber therein are sized and shaped to snuggly accommodate the compartment 14 of the lighter.

Figure 3:
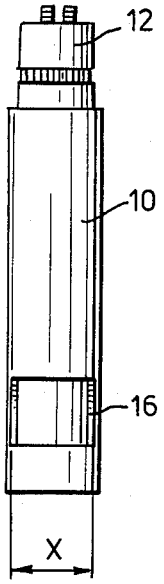
FIG. 3 is a front view of the bottle opener and lighter of FIG. 1.
Figure 2:
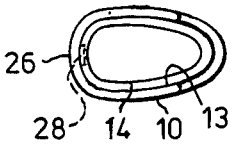
FIG. 2 is a bottom end view of the opener and lighter of FIG. 1.
Figure 4:
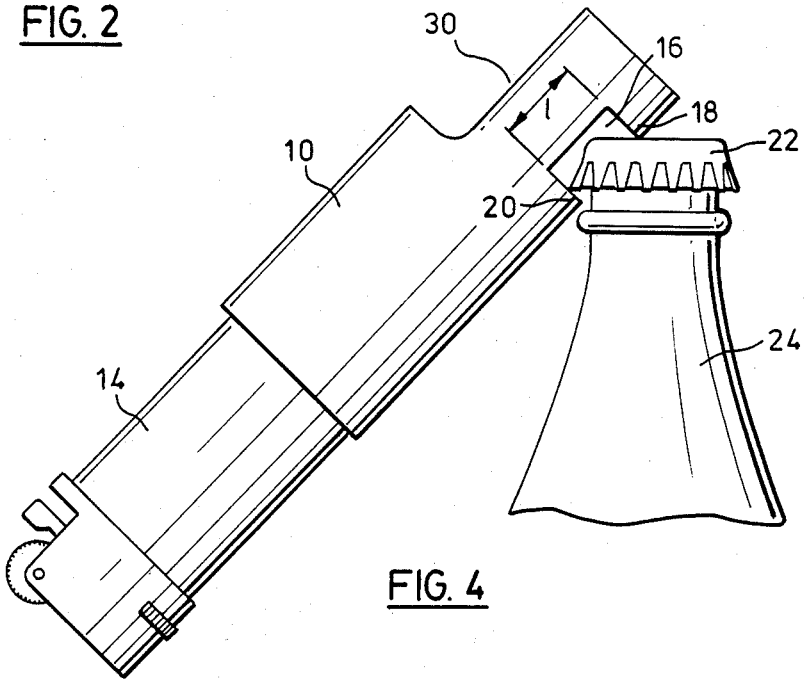
FIG. 4 is an illustration showing how the bottle opener and lighter case of the invention is used to remove a crown cap.

Formed near the bottom end of the opener 10 is a notch 16 which provides the means for removing a crown cap. The preferred notch 16 is located a short distance d from the end 17. The notch forms a fulcrum 18 at one end thereof and a prying lip 20 at the opposite end thereof. As illustrated in FIG. 4, the fulcrum and prying lip are formed such that the opener 10 can be placed on a crown cap 22 in such a manner that the lip 20 engages a bottom edge of the cap and the fulcrum 18 engages, and extends partially across, the top surface of the cap such that when the opener is pivoted upwardly with respect to the bottle 24, the cap 22 is removed. In the preferred embodiment that is shown, the notch 16 has a generally rectangular shape when the opener is viewed from the front as shown in FIG. 3. Also, it is located in a narrower side section 26 of the body 11. The length 1 of the notch 16 can vary from approximtely $\frac{3}{8}$ inch to $\frac{3}{4}$ inch but the preferred length is approximately $\frac{1}{2}$ inch for removing a standard crown cap. The width of the notch (when the plate material forming the opener is flat and not rolled into the oval shape) is in the range of $\frac{1}{2}$ inch to 1 inch, with the width in one preferred embodiment being 11/16th inch. Measured in a straight line from one longitudinal edge to the opposite edge of the notch, the distance x in the preferred embodiment is approximately $\frac{1}{2}$ inch.

In order to give the opener 10 sufficient strength for its opening function, the body 11 is made substantially of steel plate having sufficient thickness that it will not bend or fail when it is used properly to remove a crown cap.

Preferably the end 17 of the opener is open or substantially open to permit easy removal or partial removal of the disposable lighter from the opener (see FIG. 4). If desired, a small lip or flange 28 can be formed on the opener at the end 17 to prevent the lighter from falling out of the opener at this end. By partly removing the disposable lighter as shown in FIG. 4, the chamber 13 in the region of the notch 16 is cleared so that the notch can be used to remove a crown cap. When the opener is to be used for this purpose, the lighter can either be wholly removed from the opener or only partially removed as shown in FIG. 4. When the lighter is only partially removed as shown, the lighter effectively increases the length of the opener and thus assists the user by providing extra leverage for the removal of the cap.

A preferred and highly desirable feature of the present opener is the provision of a cut-out 30 extending from the end 17 of the body to a point 32 spaced from the end 17. In the preferred embodiment the cut-out 30 is disposed in a side of the body 11 opposite the notch 16. The purpose of this cut-out is to make it very easy to remove the lighter from the opener. The notch is sufficiently wide that a finger or thumb can easily be used to push the lighter part way out of the opener. After this step has been done, it is an easy matter to pull the lighter the rest of the way out of the opener. In one particular preferred embodiment, the length Y of the cut-out 30 is approximately one inch. Also, the preferred width of the cut-out from one longitudinal edge 34 to the opposite longitudinal edge, measured in a straight line, is approximately one-half inch.

It will be appreciated by those skilled in this art that various modifications and changes can be made to the illustrated embodiment described herein without departing from the spirit and scope of this invention. As an example only, it is possible to make the body 11 from a material other than steel, such as plastic. In a plastic version of the invention, a suitable metal insert can be placed in the region of the notch 16 to provide the necessary strength in this region. All such modifications and changes as fall within the scope of the appended claims are intended to be part of this invention.

I therefore claim:

1. A combination bottle opener and lighter case comprising an elongate metal body formed by a wall that extends about a longitudinal axis, said wall defining an internal hollow chamber with an opening at one end of the body such that a disposable lighter can be inserted longitudinally into the chamber, said body having internal cross-sectional dimensions of such size that said body accommodates said lighter in a snug fitting manner and a notch for removing a crown cap from a bottle, said notch being located in said wall a short distance from one end of said body, said notch forming a fulcrum at one end thereof and a prying lip at the opposite end thereof, the fulcrum and prying lip being formed such that the opener can be placed on a crown cap in such a manner that the lip engages a bottom edge of the cap and the fulcrum engages, and extends partially across, the top surface of the cap such that when the opener is pivoted upwardly with respect to the bottle, the cap is removed.

2. A bottle opener according to claim 1 wherein said wall has a substantially oval-shaped cross-section and said notch is located in a narrower side section of said wall.

3. A bottle opener according to claim 2 wherein said body is made substantially of steel.

4. A combination bottle opener and lighter case comprising an elongate body having an internal hollow chamber with an opening at one end of the body such that a disposable lighter can be inserted longitudinally into the chamber, and a notch for removing a crown cap from a bottle, said notch being located in the side of said bottle opener a short distance from one end of said body, said notch forming a fulcrum at one end thereof and a prying lip at the opposite end thereof, the fulcrum and prying lip being formed such that the opener can be placed on a crown cap in such a manner that the lip engages a bottom edge of the cap and the fulcrum engages, and extends partially across, the top surface of the cap such that when the opener is pivoted upwardly with respect to the bottle, the cap is removed, wherein said body has a cut-out extending from said other end of the body to a point spaced from said other end, said cut-out being disposed in a side of said body opposite said notch.

5. A bottle opener according to claim 4 wherein said cut-out is approximately one inch long and approximately half an inch wide measured between longitudinal edges on opposite sides of said cut-out.

6. A bottle opener according to claim 4 wherein said notch has a length in the $\frac{3}{8}$ inch to $\frac{3}{4}$ inch range.

7. A bottle opener according to claim 4 wherein said notch has a length of approximately one half inch.

8. A combination bottle opener and lighter case comprising an elongate steel body having an internal hollow chamber with an opening at one end of the body such that a disposable lighter can be inserted longitudinally into the chamber and a further opening at the other end of the body such that said lighter can easily be removed from said chamber by pushing on the bottom end of said lighter with a user's finger, and a notch for removing a crown cap from a bottle, said notch being located in the side of said bottle opener a short distance from one end of said body, said notch forming a fulcrum at one end thereof and a prying lip at the opposite end thereof, the fulcrum and prying lip being formed such that the opener can be placed on a crown cap in such a manner that the lip engages a bottom edge of the cap and the fulcrum engages, and extends partially across, the top surface of the cap such that when the opener is pivoted upwardly with respect to the bottle, the cap is removed.

9. A bottle opener according to claim 8 wherein said body has a substantially oval-shaped cross-section and said notch is located in a narrower side section of said body.

10. A bottle opener according to claim 9 wherein said body has a cut-out extending from one end of the body to a point spaced from said one end, said cut-out being disposed in a side of said body opposite said notch.

* * * * *